US009123513B2

(12) United States Patent
Simmons

(10) Patent No.: US 9,123,513 B2
(45) Date of Patent: Sep. 1, 2015

(54) METHOD FOR MASS ANALYSIS

(71) Applicant: DH TECHNOLOGIES DEVELOPMENT PTE. LTD., Singapore (SG)

(72) Inventor: Douglas A. Simmons, Maple, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/353,766

(22) PCT Filed: Oct. 26, 2012

(86) PCT No.: PCT/IB2012/002156

§ 371 (c)(1),
(2) Date: Apr. 23, 2014

(87) PCT Pub. No.: WO2013/061144

PCT Pub. Date: May 2, 2013

(65) Prior Publication Data

US 2014/0312220 A1 Oct. 23, 2014

Related U.S. Application Data

(60) Provisional application No. 61/551,546, filed on Oct. 26, 2011.

(51) Int. Cl.
*H01J 49/40* (2006.01)
*H01J 49/00* (2006.01)

(52) U.S. Cl.
CPC ..... *H01J 49/0031* (2013.01); *H01J 49/004* (2013.01); *H01J 49/0027* (2013.01)

(58) Field of Classification Search
USPC ..... 250/281, 282, 283, 286, 287
See application file for complete search history.

(56) References Cited

U.S. PATENT DOCUMENTS

2003/0078739 A1* 4/2003 Norton et al. ..... 702/22
2006/0289736 A1* 12/2006 Yamashita et al. ..... 250/282
2010/0288918 A1* 11/2010 Satulovsky ..... 250/282

* cited by examiner

*Primary Examiner* — Nicole Ippolito
(74) *Attorney, Agent, or Firm* — John R. Kasha; Kelly L. Kasha; Kasha Law LLC

(57) ABSTRACT

A method and system for analyzing a sample for an iterative information dependent acquisition cycle is disclosed, the method comprising performing an initial survey mass spectrum to generate a spectral peak list from the initial survey mass spectrum, applying threshold criteria to the spectral peak list to generate a threshold spectral peak list, performing a dependent MS/MS on the threshold peak list to obtain a plurality of mass spectra, and based on the plurality of mass spectra, determining exclusion criteria for a plurality of subsequent surveys. For each subsequent scan, the exclusion criteria are applied to generate a precursor list. The subsequent mass spectra for precursors that are common to previous IDA cycles are summed with spectra for the plurality of mass spectra from previous IDA cycles to obtain summed mass spectra.

15 Claims, 2 Drawing Sheets

METHOD FOR MASS ANALYSIS

RELATED APPLICATIONS

This application claims the benefit and priority of U.S. Provisional Application No. 61/551,546 filed Oct. 26, 2011, the entire teachings of which are incorporated herein by reference.

FIELD

The applicants' teachings relate to a method for analysis by mass spectrometry.

INTRODUCTION

Mass spectrometers are used for producing mass spectrum of a sample to find its composition. This is normally achieved by ionizing the sample and separating ions of differing masses and recording their relative abundance by measuring intensities.

Additional information (aside from precursor mass) on a given ion can then be obtained by fragmenting the ion via CID (collision induced dissociation) in a collision cell (or other means) to generate an MSMS (mass spectrum/mass spectrum) spectrum. In most instruments with MSMS capabilities, the process of generating a mass spectrum, selecting a precursor ion and obtaining a MSMS spectrum can be performed in an automated mode over an LC (liquid chromatography) analysis (or by infusion). This mode of acquisition is frequently referred to as Information Dependant Acquisition (IDA) or Data Dependant Experiment (DDE).

Information Dependent Acquisition (IDA) puts considerable demands on instrument speed and sensitivity. It is critical that instrument time during each IDA cycle is allocated to produce the most informative MS/MS spectra.

It is therefore an object of the present teachings to provide a method for fast and accurate IDA.

SUMMARY

In accordance with an aspect of the applicant's teachings, there is provided a method of analyzing a sample by a plurality of information dependent acquisition (IDA) cycles, each cycle comprising:

a) performing a initial survey mass spectrum to generate a spectral peak list from the initial survey mass spectrum;
b) applying threshold criteria to the spectral peak list to generate a thresholded spectral peak list;
c) performing a dependent MS/MS on the thresholded peak list to obtain a plurality of mass spectra; and
d) applying exclusion criteria on the plurality of mass spectra to generate a subsequent peak list to be applied during precursor selection for subsequent information dependent acquisition cycles.

In accordance with another aspect of the applicant's teachings there is provided a system for analyzing a sample by a plurality of information dependent acquisition (IDA) cycles, comprising:

a mass spectrometer;

a processor in communication with the mass spectrometer, wherein the processor for each cycle:

a) performs an initial survey mass spectrum to generate a spectral peak list from the initial survey mass spectrum;
b) applies threshold criteria to the spectral peak list to generate a thresholded spectral peak list;
c) instructs the mass spectrometer to perform a dependent MS/MS on the thresholded peak list to obtain a plurality of mass spectra;
d) applies exclusion criteria on the plurality of mass spectra to generate a subsequent peak list to be applied during precursor selection for subsequent information dependent acquisition cycles;
e) performs a subsequent survey mass spectrum to generate a subsequent spectral peak list from the subsequent survey mass spectrum;
f) applies the threshold criteria to the subsequent spectral peak list to generate a subsequent thresholded peak list;
g) applies the exclusion criteria to the subsequent thresholded peak list to generate a precursor list;
h) instructs the mass spectrometer to perform a dependent MS/MS on the precursor list to obtain a plurality of subsequent mass spectra;
i) sums the subsequent mass spectra for precursors that are common to previous IDA cycles with spectra for the plurality of mass spectra from previous IDA cycles to obtain summed mass spectra;
j) applies exclusion criteria on the summed mass spectra and on mass spectra for remaining precursors; and
k) repeats steps e) to j) until the plurality of IDA cycles are completed.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicants' teachings in anyway.

In the drawings, like reference numerals indicate like parts.

DESCRIPTION OF VARIOUS EMBODIMENTS

Figure 1:
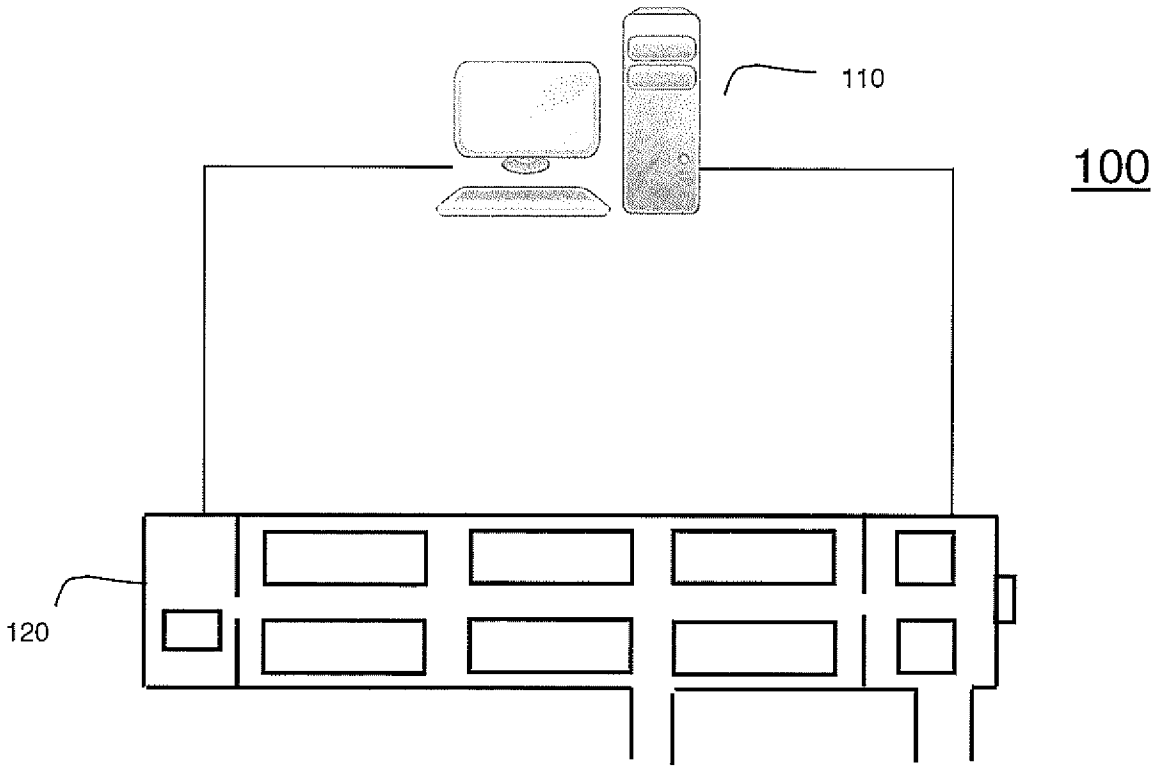
FIG. 1 is a schematic diagram showing a system for mass analysis.

Turning now to FIG. 1 which schematically illustrates a system for mass analysis in accordance with the applicants' teachings, and generally referenced by the numeral 100. System 100 includes processor 110 and mass spectrometer 120. Processor 110 can be, but is not limited to, a computer, microprocessor, or any device capable of processing data and sending and receiving control signals and data from mass spectrometer 120. Mass spectrometer 120 can include, but is not limited to time-of-flight (TOF), quadrupole, ion trap, and Fourier Transform.

Consistent with certain implementations of the present teachings, results are provided by the processor 110 executing one or more sequences of one or more instructions contained in memory. Such instructions can be read into memory from another computer-readable medium, such as storage device. Execution of the sequences of instructions contained in memory causes processor 110 to perform the process described herein. Alternatively hard-wired circuitry can be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 110 for execution. Such a medium can take many forms, including but not limited to, non-volatile media, volatile media, and transmission media. Non-volatile media includes, for example, optical or magnetic disks, such as a storage device.

Common forms of computer-readable media include, for example, a floppy disk, a flexible disk, hard disk, magnetic tape, or any other magnetic medium, a CD-ROM, any other optical medium, punch cards, papertape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or can be acquired from practicing of the present teachings. Additionally, the described implementation includes software but the present teachings can be implemented as a combination of hardware and software or in hardware alone. The present teachings can be implemented with both object-oriented and non-object-oriented programming systems.

Figure 2:
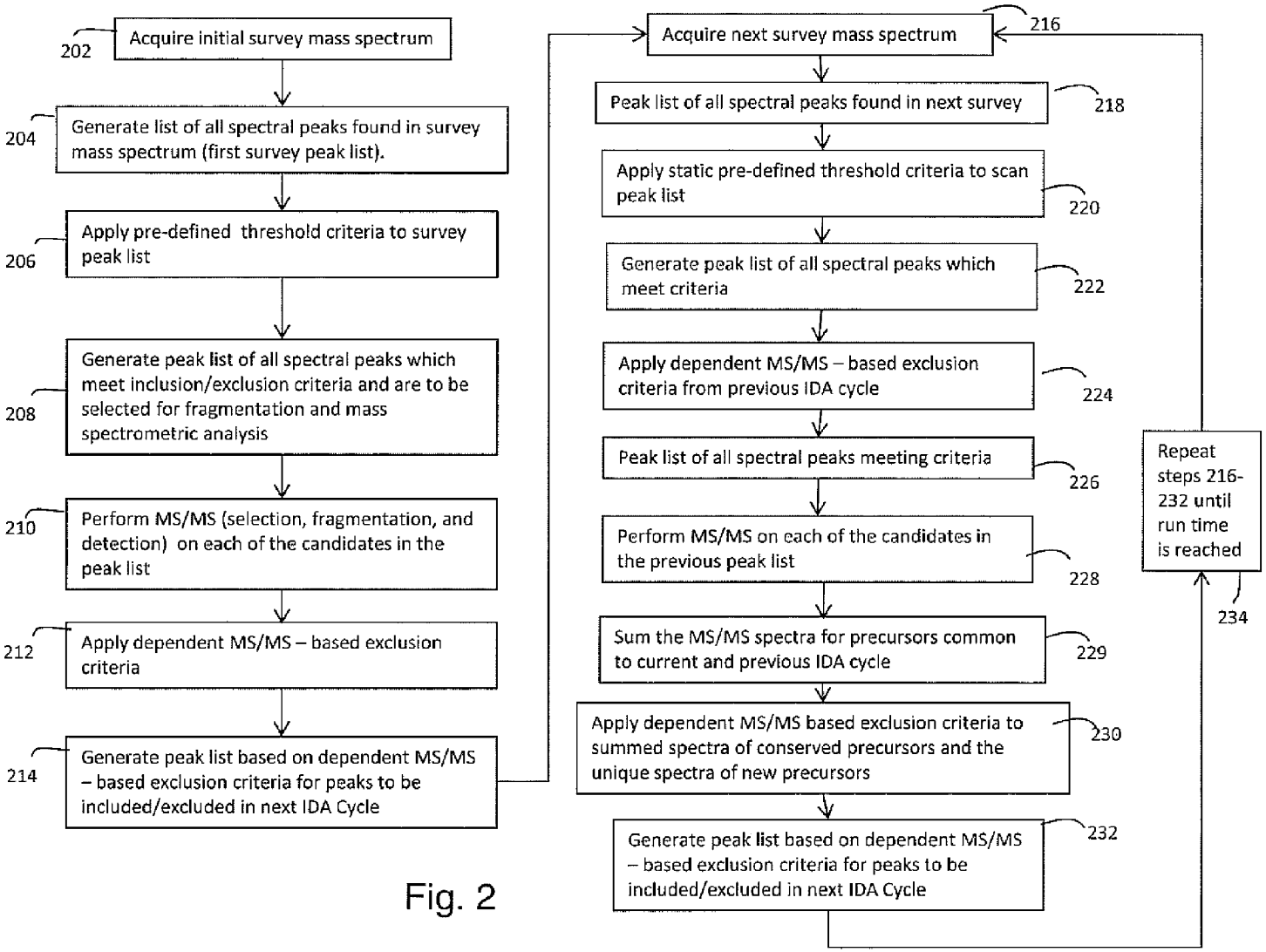
FIG. 2 is an exemplary flowchart showing a method for mass analysis using an iterative IDA cycle in accordance with the present teachings.

FIG. 2 is an exemplary flowchart showing a method 200 for mass analysis on a sample using an iterative IDA cycle in accordance with the present teachings.

In step 202, an initial survey scan is performed. A full mass spectrum of all ions detected across a predefined m/z range is obtained. In step 204, a list of all spectral peaks from the initial survey mass spectrum is generated. In step 206, the processor 110 applies the predefined threshold criteria to the initial survey peak list. Predefined threshold criteria are used to eliminate peaks from the list that are not of interest in the analysis. These criteria can include but are not limited to minimum intensity threshold, charge state, mass defect, and m/z range.

In step 208, a precursor list is generated based on the initial survey peak list results that meet the applied predefined threshold criteria. The precursor list is selected for fragmentation and MS/MS. In step 210, MS/MS is performed by the mass spectrometer 120 on the precursor list.

In step 212, calculations are performed by the processor 110 on the mass spectra, resulting from step 210, to produce a list of peaks in step 214 that are to be excluded from the subsequent precursor list for the dependent MS/MS analysis in the subsequent IDA cycle.

For example, during each IDA cycle, a plurality of MS/MS mass spectra are generated. Calculations are performed individually on each MS/MS mass spectrum in order to determine if the associated precursor ion is to remain eligible in the subsequent IDA cycles. Some examples of eligibility conditions can include but are not limited to total ion current, individual peak intensity, or the presence of a predetermined diagnostic ion.

In step 216, a subsequent survey scan is performed. In step 218, a list of all spectral peaks from the subsequent survey mass spectrum is generated. In step 220, the processor 110 applies the predefined threshold criteria to the subsequent survey peak list. Predefined threshold criteria are used to eliminate peaks from the list that are not of interest in the analysis. These criteria can include but are not limited to minimum intensity threshold, charge state, mass defect, and m/z range.

In step 222, a subsequent precursor list is generated based on the subsequent survey peak list results that meet the applied predefined threshold criteria. In step 224, the ions defined in the exclusion peak list generated in step 214 are removed from the precursor list, generating a subsequent modified precursor list in step 226. The ions of the peaks of the subsequent modified precursor list are then selected for fragmentation and MS/MS analysis by the mass spectrometer 120 in step 228.

In step 229, for those precursors that are common to or conserved from the previous IDA cycle, the resultant MS/MS spectra from the current IDA cycle are summed with the respective MS/MS spectra from previous IDA cycle or cycles.

In step 230, calculations are performed by the processor 110 on the summed mass spectra of conserved precursors and the mass spectra of new precursors in order to determine if each associated precursor ion is to remain eligible in the subsequent IDA cycles. This results in a list of peaks in step 232 that are to be excluded from the subsequent precursor list for the dependent MS/MS analysis in the subsequent IDA cycle.

In step 234, the IDA cycle is repeated, returning to step 216. The IDA cycle is repeated until a specified run time is completed.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicants' teachings have been particularly shown and described with reference to specific illustrative embodiments, it should be understood that various changes in form and detail can be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicants' teachings have been described in conjunction with various embodiments and examples, it is not intended that the applicants' teachings be limited to such embodiments or examples. On the contrary, the applicants' teachings encompass various alternatives, modifications, and equivalents, as will be appreciated by those of skill in the art, and all such modifications or variations are believed to be within the sphere and scope of the invention.

The invention claimed is:

1. A method of analyzing a sample by a plurality of information dependent acquisition (IDA) cycles, each cycle comprising:

a) performing an initial survey mass spectrum to generate a spectral peak list from the initial survey mass spectrum;

b) applying a minimum precursor intensity criterion to the spectral peak list to generate a thresholded spectral peak list;

d) performing a dependent MS/MS on the thresholded peak list to obtain a plurality of mass spectra; and e) applying an exclusion criterion to the plurality of mass spectra to generate a subsequent peak list to be applied during precursor selection for subsequent information dependent acquisition cycles.

2. The method of claim 1 further comprising:

f) performing a subsequent survey mass spectrum to generate a subsequent spectral peak list from the subsequent survey mass spectrum;

g) applying the minimum precursor intensity criterion to the subsequent spectral peak list to generate a subsequent thresholded peak list;

h) applying the exclusion criterion to the subsequent thresholded peak list to generate a precursor list;

i) performing a dependent MS/MS on the precursor list to obtain a plurality of subsequent mass spectra;

j) summing the subsequent mass spectra for precursors that are common to previous IDA cycles with spectra for the plurality of mass spectra from previous IDA cycles to obtain summed mass spectra;

k) applying the exclusion criterion to the summed mass spectra and on mass spectra for remaining precursors; and l) repeating steps f) to k) until the plurality of IDA cycles are completed.

3. The method of claim 1, wherein the exclusion criterion comprises total ion current.

4. The method of claim 1, wherein the exclusion criterion comprises an individual peak intensity.

5. The method of claim 1, wherein the exclusion criterion comprises the presence of a predetermined diagnostic ion.

6. A method of analyzing a sample by a plurality of information dependent acquisition (IDA) cycles, each cycle comprising:

a) performing an initial survey mass spectrum to generate a spectral peak list from the initial survey mass spectrum;

b) applying a charge state criterion to the spectral peak list to generate a thresholded spectral peak list;

d) performing a dependent MS/MS on the thresholded peak list to obtain a plurality of mass spectra; and e) applying an exclusion criterion to the plurality of mass spectra to generate a subsequent peak list to be applied during precursor selection for subsequent information dependent acquisition cycles, wherein the exclusion criteria include one of a base peak intensity, total ion current and fragmentation pattern.

7. The method of claim 6, further comprising:

f) performing a subsequent survey mass spectrum to generate a subsequent spectral peak list from the subsequent survey mass spectrum;

g) applying the charge state criterion to the subsequent spectral peak list to generate a subsequent thresholded peak list;

h) applying the exclusion criterion to the subsequent thresholded peak list to generate a precursor list;

i) performing a dependent MS/MS on the precursor list to obtain a plurality of subsequent mass spectra;

j) summing the subsequent mass spectra for precursors that are common to previous IDA cycles with spectra for the plurality of mass spectra from previous IDA cycles to obtain summed mass spectra;

k) applying the exclusion criterion to the summed mass spectra and on mass spectra for remaining precursors; and l) repeating steps f) to k) until the plurality of IDA cycles are completed.

8. The method of claim 6, wherein the exclusion criterion comprises total ion current.

9. The method of claim 6, wherein the exclusion criterion comprises an individual peak intensity.

10. The method of claim 6, wherein the exclusion criterion comprises the presence of a predetermined diagnostic ion.

11. A method of analyzing a sample by a plurality of information dependent acquisition (IDA) cycles, each cycle comprising:

a) performing an initial survey mass spectrum to generate a spectral peak list from the initial survey mass spectrum;

b) applying a mass defect criterion to the spectral peak list to generate a thresholded spectral peak list;

d) performing a dependent MS/MS on the thresholded peak list to obtain a plurality of mass spectra; and e) applying an exclusion criterion to the plurality of mass spectra to generate a subsequent peak list to be applied during precursor selection for subsequent information dependent acquisition cycles, wherein the exclusion criteria include one of a base peak intensity, total ion current and fragmentation pattern.

12. The method of claim 11, further comprising:

f) performing a subsequent survey mass spectrum to generate a subsequent spectral peak list from the subsequent survey mass spectrum;

g) applying the mass defect criterion to the subsequent spectral peak list to generate a subsequent thresholded peak list;

h) applying the exclusion criterion to the subsequent thresholded peak list to generate a precursor list;

i) performing a dependent MS/MS on the precursor list to obtain a plurality of subsequent mass spectra;

j) summing the subsequent mass spectra for precursors that are common to previous IDA cycles with spectra for the plurality of mass spectra from previous IDA cycles to obtain summed mass spectra;

k) applying the exclusion criterion to the summed mass spectra and on mass spectra for remaining precursors; and l) repeating steps f) to k) until the plurality of IDA cycles are completed.

13. The method of claim 11, wherein the exclusion criterion comprises total ion current.

14. The method of claim 11, wherein the exclusion criterion comprises an individual peak intensity.

15. The method of claim 11, wherein the exclusion criterion comprises the presence of a predetermined diagnostic ion.

* * * * *